US006622633B1

(12) United States Patent
Johnsen et al.

(10) Patent No.: US 6,622,633 B1
(45) Date of Patent: Sep. 23, 2003

(54) RAILROAD MACHINE CENTERING SYSTEM

(75) Inventors: David Sean Johnsen, Wauwatosa, WI (US); William D. Straub, Milwaukee, WI (US); Bruce M. Boczkiewicz, Mukwonago, WI (US)

(73) Assignee: Nordco Inc., Milwaukee, WI (US)

( * ) Notice: Subject to any disclaimer, the term of this patent is extended or adjusted under 35 U.S.C. 154(b) by 0 days.

(21) Appl. No.: 10/113,360

(22) Filed: Mar. 29, 2002

(51) Int. Cl.[7] ..... E01B 33/00
(52) U.S. Cl. ..... 104/7.2; 104/2
(58) Field of Search ..... 104/2, 7.1, 7.2, 104/8

(56) References Cited

U.S. PATENT DOCUMENTS 3,338,174 A * 8/1967 Oville ..... 104/8
4,111,128 A * 9/1978 Keyes ..... 104/7.2
4,565,133 A * 1/1986 Moore ..... 104/7.2
5,025,733 A * 6/1991 Pierobon ..... 104/7.1
5,419,259 A * 5/1995 Theurer et al. ..... 104/7.2
6,089,163 A * 7/2000 Williams ..... 104/2

* cited by examiner

*Primary Examiner*—S. Joseph Morano
*Assistant Examiner*—Lars A. Olson
(74) *Attorney, Agent, or Firm*—Greer, Burns, & Crain Ltd.

(57) ABSTRACT

A railway maintenance device movable on a railroad track having a pair of spaced rails, the device including a frame configured for movement relative to the track and having at least two side members. At least one track contacting element is associated with at least one of the sides. An adjustment mechanism is provided for adjusting the relative position of at least one of the track contacting elements to the frame to thus position the frame relative to the rails. The device preferably includes a fluid power cylinder associated with each track contacting element to control the position of the wheel relative to the frame, as well as a stop mechanism for adjustably limiting the pivoting action of the contacting element relative to the frame, and thus control the displacement of the element.

18 Claims, 3 Drawing Sheets

RAILROAD MACHINE CENTERING SYSTEM

BACKGROUND OF THE INVENTION

This application relates generally to railway right of way maintenance equipment of the type used to repair and maintain railroad track. More specifically, the present invention relates to an apparatus for maintaining railway right of way maintenance devices centered on the track upon which they are working.

Conventional railroad track consists of a plurality of spaced parallel wooden ties to which are attached a pair of spaced rail tie plates. Each tie plate is configured to rest on the upper surface of the tie and includes holes for receiving spikes or screws, as well as a canted seat or a cradle formation for receiving the bottom of the steel rail. Since two rails make up a railroad track, there are a pair of spaced tie plates on each tie. Some of the spikes are used to secure the tie plate on the tie and others are used to secure the base of the rail to the tie plate cradle.

In the U.S., rails are laid to have a gauge or spacing of 56½ inches. Depending on the age of the track, the terrain and construction variables, this spacing may vary. This variation is often more pronounced on curved sections of track. Most railway maintenance vehicles are constructed so that their rail wheels are wide enough to accommodate this range of rail width variation. In addition, most rail maintenance equipment, such as, but not limited to spikers, spike removers, rail grinders, tie borers, clip removers, clip applicators and the like, is provided on a carriage which is both horizontally and vertically movable to compensate for the position of the maintenance vehicle relative to the portion of the track to be repaired.

However, in most railway maintenance operations, such as, for example, rail tie plate removal, it is important for the maintenance machine to be centered on the track. This centering will more positively position the maintenance equipment to the designated location on the track.

Thus, it is a first object of the present invention to provide an improved rail maintenance apparatus with a system for maintaining the apparatus centered on a portion of track.

Another object of the present invention is to provide an improved system for maintaining a rail maintenance apparatus centered on the track which can accommodate the range of variation typically found on commercial railroads.

SUMMARY OF THE INVENTION

The above-identified objects are met or exceeded by the present rail machine-centering device, which features independently adjustable mechanisms on each side of a frame of the unit. In one embodiment, the adjustable mechanism is configured for adjusting the position of the wheel relative to the frame. By adjusting the extension of each mechanism relative to the frame, a centered position of the frame on the track may be maintained. The device also features the ability for an operator to limit the amount of adjustment of one or more of the mechanisms relative to the frame.

More specifically, a railway maintenance device is provided that is movable on a railroad track having a pair of spaced rails, the device including a frame configured for movement relative to the track and having at least two side members. At least one track contacting element is associated with at least one of the sides. An adjustment mechanism is provided for adjusting the relative position of at least one of the track contacting elements to the frame to thus position the frame relative to the rails. The device preferably includes a fluid power cylinder associated with each track contacting element to control the position of the wheel relative to the frame, as well as a stop mechanism for adjustably limiting the pivoting action of the contacting element relative to the frame, and thus control the displacement of the element.

In another embodiment, a railway maintenance device is provided that is movable on a railroad track having a pair of spaced rails, the device includes a frame configured for movement relative to the track, at least one track contacting element is secured to the frame, and an adjustment mechanism for adjusting the position of the at least one element relative to the frame to thus position the frame relative to the rails.

DETAILED DESCRIPTION OF THE INVENTION

Figure 1:
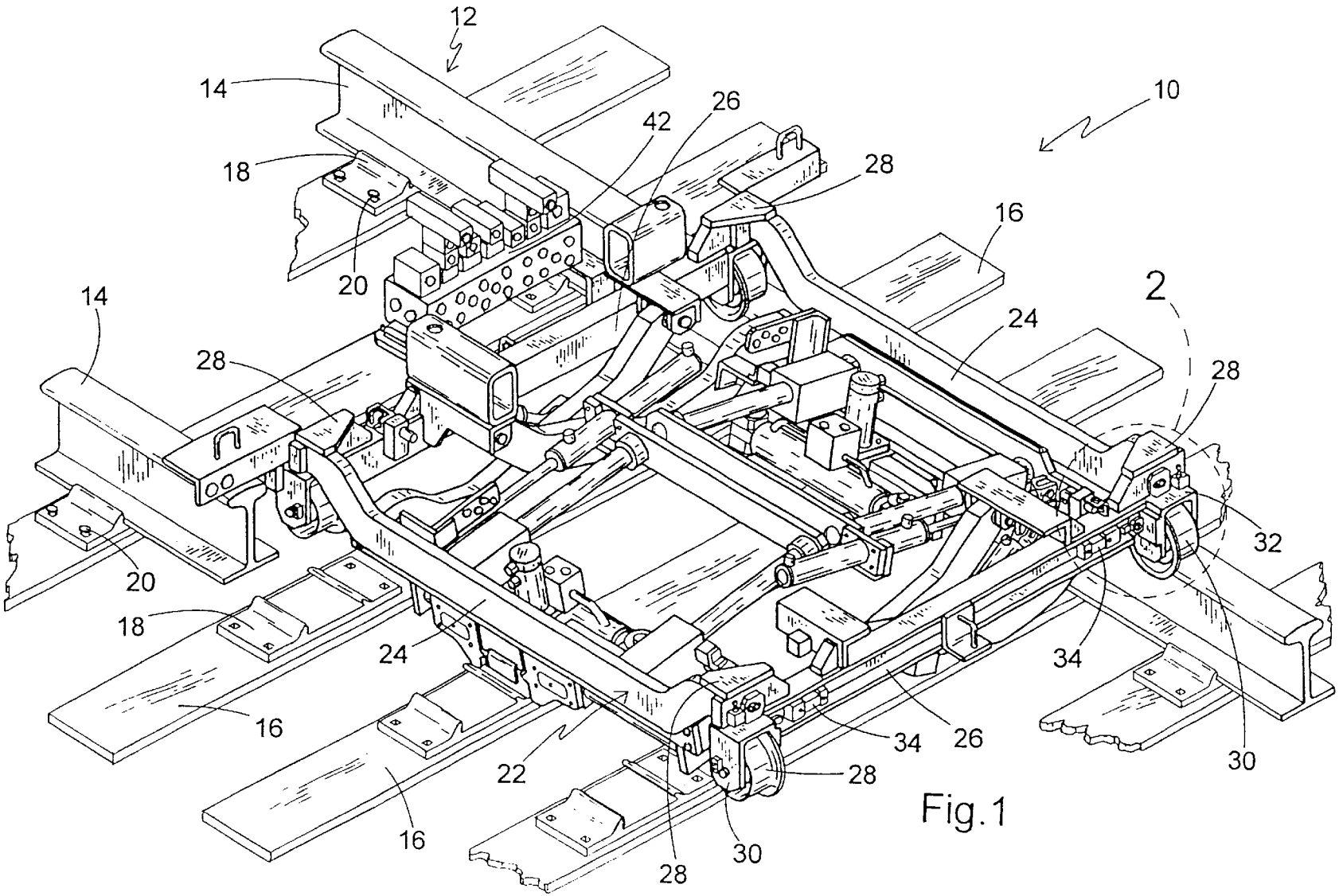
FIG. 1 is a respective elevation of a railway maintenance apparatus featuring one embodiment of the present centering system.

Referring now to FIG. 1, a railroad maintenance device suitable for use with the present system is generally designated 10, and is specifically designed for use in removing tie plates from railroad track 12. The construction and operation of the maintenance operation performed by the device 10 is described in greater detail in commonly assigned, co-pending U.S. Ser. No. 10/113,585 filed Mar. 29, 2002, entitled PLATE HANDLING SYSTEM [(Attorney Docket No. 1425.65911)] which is incorporated by reference. The present device 10 is preferably designed for use in conjunction with a rail tie extraction apparatus of the type disclosed in commonly assigned U.S. patent Ser. No. 09/810,975, filed Mar. 16, 2001, which is incorporated by reference herein. However, it is contemplated that other types of rail maintenance equipment may be serve as the device 10, including, but not limited to spike pullers and drivers, clip applicators and removers, tie extractors and inserters, tie plate handlers, tie drills, rail adzers, and other such well-known rail maintenance equipment. The track 12 is made up of a pair of spaced rails 14, which are secured to a plurality of spaced, parallel ties 16 by a plurality of tie plates 18. As is well known, the ties 16 are typically wood, but are also made of concrete in some applications. As is known in the art, the tie plates 18 are secured to the ties 16 by spikes 20 or threaded fasteners.

The device 10 includes a main frame 22 configured for movement relative to the track 12 and provided with a pair of generally parallel side members 24 and a pair of end members 26, which are connected at respective corners 28 to form a square or rectangular frame shape. It is contemplated that the shape of the frame 22 may vary to suit the application. Rail wheels 30 are preferably rotatably mounted at each corner 28 to enable the frame 22 to move along the track 12. As will be described below in greater detail, in one embodiment, each of the wheels 30 is mounted to a bracket 32 which is pivotable relative to the mainframe 22. A feature of the present invention is that at least one of the four wheels 30 serves as a track or rail contact element that is provided with an adjustment mechanism, generally designated 33 for positioning the wheel relative to the frame 22, and ultimately for centering the frame 22 relative to the track 12. The adjustment mechanism 33 includes a centering cylinder 34 mounted to the frame 22 and to a corresponding one of the brackets 32. The cylinder 34 is a fluid power cylinder (hydraulic or pneumatic), but hydraulic types are preferred. Another feature of the present device 10 is that, by adjusting the pressurization of the cylinders 34, the frame 22 is centered upon the track 12.

Figure 3:
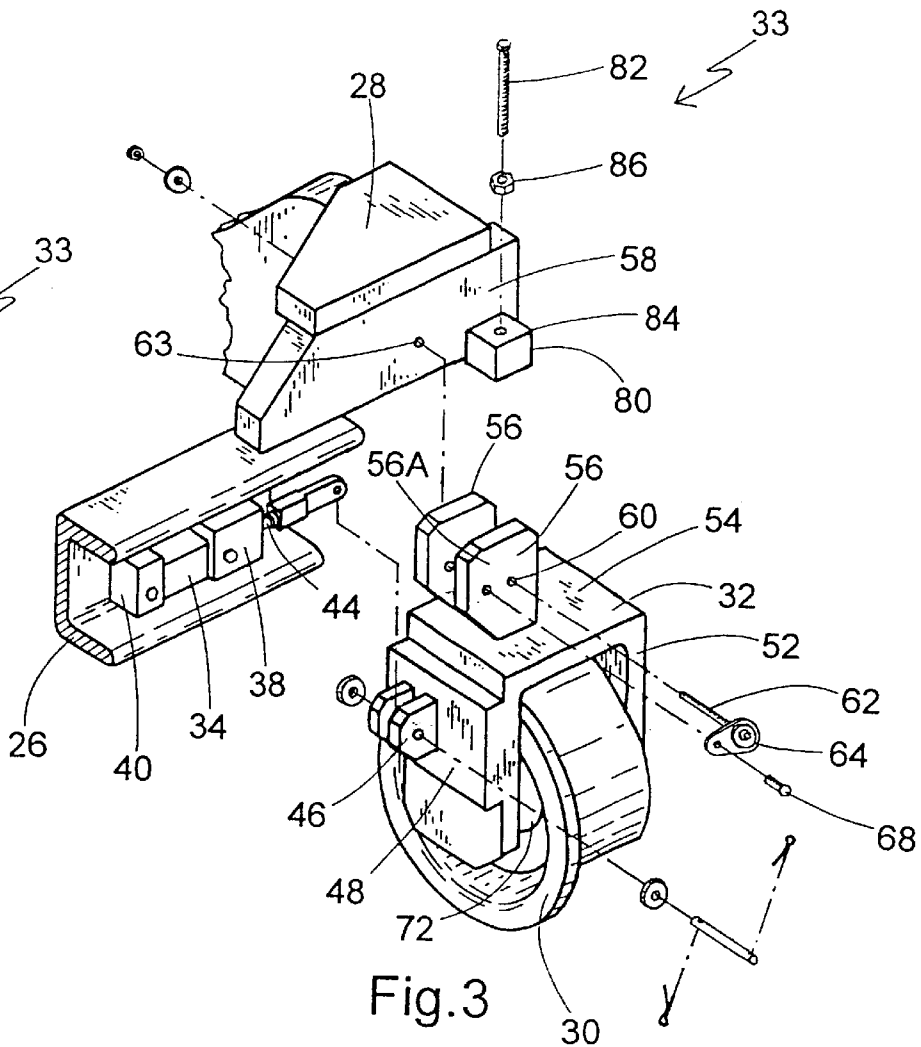
FIG. 3 an exploded perspective view of the system shown in FIG. 2.
Figure 2:
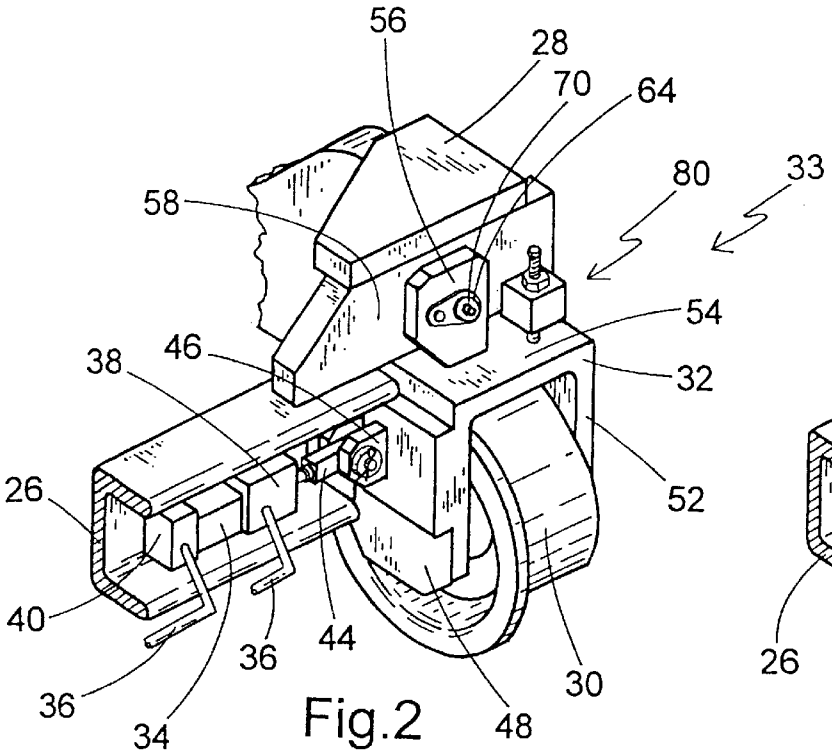
FIG. 2 is a fragmentary enlarged perspective view of the device of FIG. 1.

Referring now to FIGS. 2 and 3, each of the fluid power cylinders 34 is preferably a dual-acting hydraulic cylinder with a separate hydraulic supply line 36 connected to each of a rod end 38 and a blind end 40. While the above-described arrangement is preferred, other known fluid power cylinder arrangements are contemplated, including pneumatic cylinders, single-acting, spring-return cylinders and other equivalent cylinders known in the art. As is known in the art, each of the supply lines 36 is connected to a hydraulic manifold 42 (best seen in FIG. 1), and ultimately, to a hydraulic power unit (not shown), such as a pump, reservoir and associated valves. As is known in the art, the hydraulic control system, which includes, among other things, the supply lines 36, the manifold 42, the power unit, pump, reservoir and associated valves, is configured to power other functions of the machine, and as such is running whenever the device 10 is turned on.

A cylinder rod 44 reciprocating from the cylinder 34 between a retracted and an extended position is connected through a clevis joint 46 to an inside wall 48 of the generally "U"-shaped bracket 32. The U-shaped bracket 32 includes the inside wall 48 and an outside wall 52 in spaced, parallel relationship to each other and separated by a top wall 54. In the preferred embodiment, the bracket 32 is made of pieces of steel flat stock welded together, however other construction techniques are contemplated as are known in the art.

Protruding from the top wall 54 is a pair of spaced, generally parallel clevis ears 56 spaced a sufficient distance to receive a depending weldment 58 of the mainframe 22. Each ear 56 has a thoughbore 60 configured to receive a pivot pin 62 which also passes through a corresponding opening 63 in the weldment 58. Thus, the bracket 32 is pivotably secured to the mainframe 22. To prevent the pivot pin 62 from moving relative to the bracket 32, the pin is provided with a laterally projecting tab 64 fastened as by welding or equivalent technique near a head 66 of the pin. The tab 64 is secured to the outer ear **56*a* by a threaded fastener 68 such as a bolt. In this manner, the pivot pin 62 moves with the ear 56*a* and the bracket 32. A grease fitting 70 provides lubrication for the pivot pin 62**.

It will be seen that extension of the rod 44 to the right in FIG. 3 will cause the bracket 32 to pivot outwardly relative to the mainframe 22. In this manner, the position of the wheel 30 relative to the frame 22 is adjusted. Each wheel 30 is secured to the corresponding bracket 32 by a bearing 72 having a laterally extending axle 74 (best seen in FIG. 4) which protrudes through a corresponding aperture 76 in the wall 52 as well as through the bearing 72. The axle 74 is secured to the bracket 32 by cotter pins, locking caps, set screws or other known fasteners.

Also featured on the device 10 is a stop mechanism, generally designated 80 which limits the outward extension, or pivoting movement, of the bracket 32. In the preferred embodiment, the stop mechanism 80 is a threaded fastener 82 such as a bolt, which is threadably engaged in a block 84 fastened to the mainframe 22. The bolt 82 is sufficiently long to engage the top wall 54 of the bracket 32. A locknut 86 is jammed against the block 84 to retain the bolt 82 in its desired position. It is also contemplated that the stop mechanism 80 is located on the top of the bracket 32 and engages a protrusion (not shown) on the mainframe 22.

Figure 4:
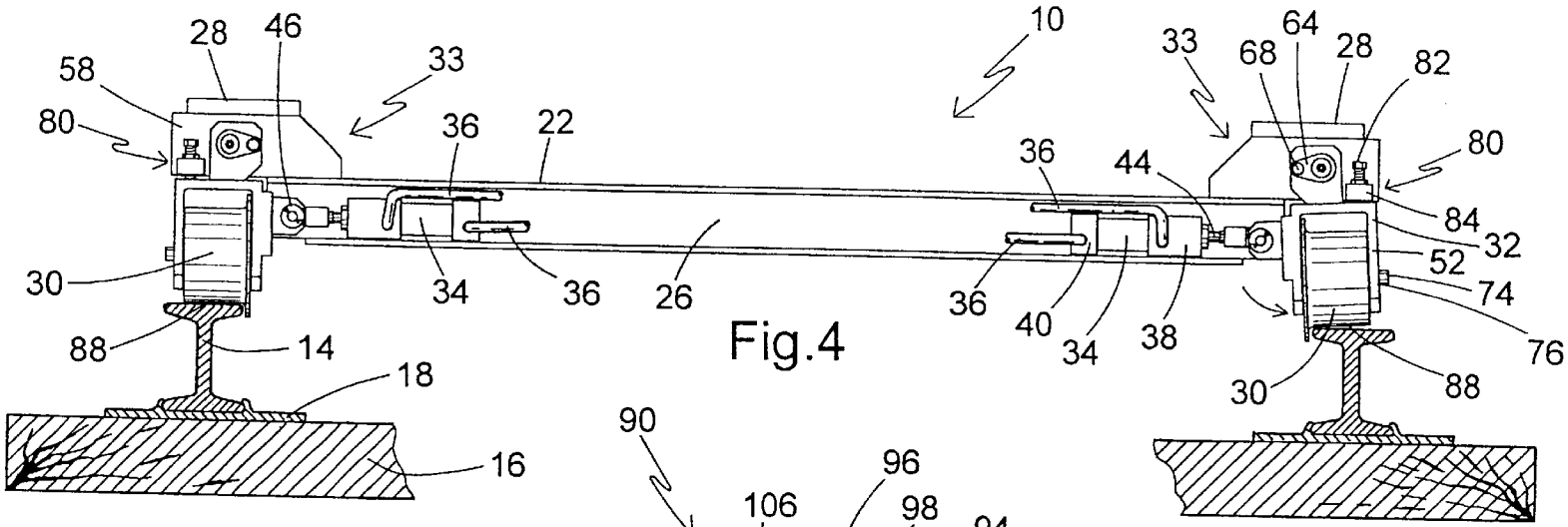
FIG. 4 is a schematic view of the present centering system shown in an extended and a retracted position while mounted to a device on the track.

Referring now to FIG. 4, it will be seen that upon pressurization of all of the cylinders 34 on the mainframe 22, that the wheels 30 will be outwardly extended or pivoted so that the wheel flanges 88 will engage the rail. As the fluid pressure equalizes among the four cylinders 34, the frame 22 will become centered on the track 12 between the rails 14. Once the desired rail maintenance operation is completed, the cylinders 34 are automatically retracted to a minimum setting of preferably 55¾ inches. In this manner, the full outward extension of the wheels can reach approximately 2 inches, providing sufficient adjustability of the device 10 in any conceivable rail track abnormality. The specific default or retracted setting may be varied to suit the application.

Figure 5:
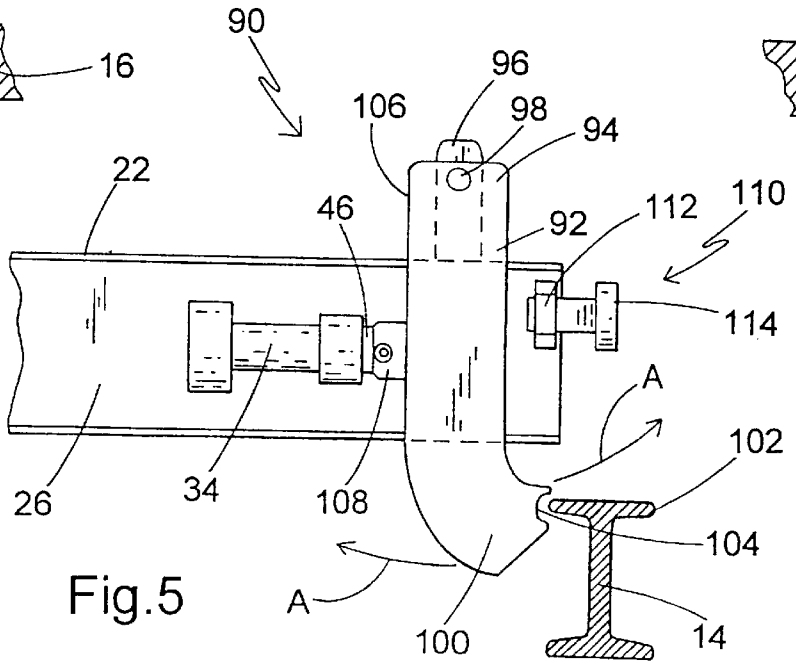
FIG. 5 is a fragmentary front view of an apparatus as shown in FIG. 4 incorporating another embodiment of the present centering system.

Referring now to FIG. 5, an alternate embodiment of the present adjustment mechanism is generally designated 90. Components of the mechanism 90 which are shared with the mechanism 33 depicted in FIGS. 1–4 are designated with identical reference numbers. A main distinction between the mechanisms 33 and 90 is that instead of the wheels 30 being adjustable relative to the main frame 22, in the mechanism 90 a track contacting element 92 is provided in the form of a centering lever having an upper or pivoting end 94 which is pivotally engaged to the main frame by being pinned to a frame ear 96 by a pivot pin 98. A lower end 100 of the element 92 is configured for engaging the rail 14, preferably at a crown 102 of the rail. As such, the lower end 100 is preferably provided with a notch or recess 104 which is configured to positively grip or engage the rail crown 102. The exact configuration of the notch 104 may vary to suit the application, as long as the rail 14 is positively engaged so that the element 92 will not easily slip off of the rail crown 102. Furthermore, the track contacting element 92 is preferably provided in a non-linear configuration where the lower end 102 projects at an angle to the upper end 94, the amount of the angular projection contemplated as varying with the particular application.

An inner edge 106 of the track contacting element 92 is provided with an eyelet 108 configured for connection to the clevis 46 of the cylinder rod 44 (best seen in FIG. 2) as described above in relation to the embodiment of FIGS. 1–4. It is contemplated that the clevis 46 could alternately be mounted on the element 92 and the eyelet 108 could be mounted to the cylinder rod 44 as is known in the art. In operation, pressurization or depressurization of the centering cylinder 34 moves the track contacting element 92 respectively toward and away from the rail 14 in the direction of the arrows A. When mechanisms 90 are provided along each respective side member 24, each of the rails 14 of the track 12 will be engaged by at least one element 92. Pressurization of the respective centering cylinders 34 will cause the elements 92 to engage the track so that the frame 22 will become centered on the track.

As is the case with the embodiment of FIGS. 1–4, the mechanism 90 is preferably provided with a stop mechanism, generally designated 110. The stop mechanism 110 limits the outward pivoting movement of the track contacting element 92. A threaded receptacle or nut 112 is secured to the frame 22, preferably on the end member 26 in a position which is closely adjacent the pivot arc of the element 92. A threaded bolt, fastener or rod 114 engages the receptacle 112 in the same manner as the stop mechanism 80. Axial rotation of the rod 114 relative to the receptacle 112 can be used to reduce the arc traveled by the track contacting element 92 as desired.

While a particular embodiment of the present railroad machine centering system has been disclosed herein, it will be appreciated by those skilled in the art that changes and modifications may be made thereto without departing from the invention in its broader aspects and as set forth in the following claims.

What is claimed is:

1. A railway maintenance device movable on a railroad track having a pair of spaced rails, said device comprising:

a frame configured for movement relative to the track and having a side member associated with each of the rails;

at least one track contacting element associated with at least one of the rails; and an adjustment mechanism for adjusting the relative position of said track contacting elements to said frame to thus position said frame relative to said rails;

said at least one track contacting element is pivotally mounted to said frame and said adjustment mechanism is configured so that energization of said adjustment mechanism causes said at least one track contacting element associated with each of the rails to pivot relative to said frame and center said frame relative to the rails.

2. The device of claim 1 further including at least one fluid power cylinder associated with said frame and connected to a corresponding one of said track contacting elements for adjusting the position of said element relative to said frame.

3. The device of claim 1 further including a stop mechanism configured for limiting the pivoting action of said at least one track contacting element.

4. The device of claim 1 wherein said at least one track contacting element is at least one of a set of four wheels by which said frame travels relative to the track.

5. A railway maintenance device movable on a railroad track having a pair of spaced rails, said device comprising:

a frame configured for movement relative to the track and having a side associated with each of the rails;

at least one track contacting element being mounted to said frame so that there is at least one track contacting element associated with each of the rails, said at least one track contacting elements being movable between a retracted and an extended position; and an adjustment mechanism for adjusting the position of said least one track contacting element to said frame to thus position said frame relative to the rails;

said adjustment mechanism being configured so that upon pressurization of said rail contacting elements, said elements are outwardly extended so that elements engage the rail, and as pressure equalizes among the elements, the frame will become centered on the track between the rails.

6. The device of claim 5 wherein said at least one track contact element includes a plurality of wheels configured for rolling engagement with said track, said wheels being pivotably mounted to said frame.

7. The device of claim 5 wherein said adjustment mechanism includes a fluid power cylinder mounted to said frame adjacent said at least one track contacting element for adjusting the position of said corresponding element relative to said frame.

8. The device of claim 5 wherein each said element is mounted in a bracket which is pivotably mounted to said frame.

9. The device of claim 8 wherein each said bracket is mounted to said frame with a pin and clevis arrangement.

10. The device of claim 8 wherein said adjustment mechanism includes a fluid power cylinder mounted to said frame adjacent said at least one element and each said cylinder is connected to said corresponding bracket for moving said element between a retracted position and an extended position.

11. The device of claim 10 wherein said adjustment mechanism is configured so that upon pressurization of said cylinders, said frame is centered between the rails.

12. The device of claim 5 wherein said adjustment mechanism further includes a stop means for limiting the movement of said element relative to said frame.

13. The device of claim 12 wherein each said element is mounted in a bracket which is pivotably mounted to said frame, and said stop means is configured to limit the pivoting movement of said bracket.

14. The device of claim 13 wherein said stop means is a threaded fastener disposed on said frame to engage said bracket and limit said pivoting movement.

15. The device of claim 5 further including a hydraulic control system for providing fluid pressure and for controlling the flow of the fluid pressure to said adjustment mechanism.

16. A railway maintenance device movable on a railroad track having a pair of spaced rails, said device comprising:

a frame configured for movement relative to the track;

at least two track contact elements secured to said frame, at least one of said contact elements associated with a respective rail of the track, and being pivotable relative to said frame; and an adjustment mechanism including a fluid power cylinder mounted to said frame adjacent each of said contact elements and each said cylinder is connected to said corresponding bracket for moving said contact element between a retracted position and an extended position to thus position said frame relative to said rails; and said device mechanism further including a threadably adjustable stop means for limiting the extended movement of at least one of said contact elements relative to said frame.

17. The device of claim 16 wherein said track contact elements are at least one wheel configured for rolling engagement with said track, each said wheel is mounted in a bracket which is pivotably mounted to said frame.

18. The device of claim 16 wherein said track contact element have a lower end configured for positive engagement with the track.

* * * * *